US005448801A

United States Patent [19]

Wolfgang et al.

[11] Patent Number: 5,448,801

[45] Date of Patent: Sep. 12, 1995

[54] PROCESS AND DEVICE FOR FIBER SLIVER SEVERING ON A DRAW FRAME

[75] Inventors: Göhler Wolfgang, Lenting; Zehndbauer Alfons, Wttstetten, both of Germany

[73] Assignee: Rieter Ingolstadt Spinnereimaschinenbau AG, Ingolstadt, Germany

[21] Appl. No.: 204,777

[22] Filed: Mar. 2, 1994

[30] Foreign Application Priority Data

Mar. 18, 1993 [DE] Germany ..... 43 08 606.3

[51] Int. Cl.[6] ..... B65H 54/71; B65H 67/04; B65H 54/76; D01H 13/18

[52] U.S. Cl. ..... 19/159 A; 19/157; 242/18.1; 242/19

[58] Field of Search ..... 19/157, 159 A, 159 R, 19/65 T, 106 R; 242/18.1, 19

[56] References Cited

U.S. PATENT DOCUMENTS

| | | | |
|---|---|---|---|
| 3,083,416 | 4/1963 | Hashimoto . | |
| 3,334,385 | 8/1967 | West et al. . | |
| 3,354,513 | 11/1967 | Fornes | 19/159 A |
| 3,381,342 | 5/1968 | Selby et al. | 19/159 A |
| 3,613,175 | 10/1971 | Schumann et al. . | |
| 4,109,357 | 8/1978 | Burow et al. . | |
| 4,150,534 | 4/1979 | Raasch | 19/159 A X |
| 4,497,087 | 2/1985 | Oehy | 19/159 A |
| 4,561,151 | 12/1985 | Schopwinkel . | |
| 4,838,018 | 6/1989 | Hoeber | 19/157 X |
| 4,965,912 | 10/1990 | Kluttermann et al. . | |
| 5,113,550 | 5/1992 | Siegenthaler | 19/159 A |
| 5,208,946 | 5/1993 | Stentenbach | 19/159 A X |

FOREIGN PATENT DOCUMENTS

| | | |
|---|---|---|
| 0493344 | 7/1992 | European Pat. Off. . |
| 1217827 | 5/1966 | Germany . |
| 3609198A1 | 9/1987 | Germany . |
| 9014575.5 | 3/1991 | Germany . |
| 9108621.3 | 10/1991 | Germany . |
| 4028365A1 | 3/1992 | Germany . |
| 4123205A1 | 1/1993 | Germany . |
| 672502 | 11/1989 | Netherlands . |
| 436051 | 11/1967 | Switzerland . |
| 920046 | 3/1963 | United Kingdom . |
| 2039548 | 8/1980 | United Kingdom . |
| 2207445 | 2/1989 | United Kingdom . |

*Primary Examiner*—Clifford D. Crowder
*Assistant Examiner*—John J. Calvert
*Attorney, Agent, or Firm*—Dority & Manning

[57] ABSTRACT

A process and device are utilized for severing a fiber sliver on a draw frame. A fiber sliver is conveyed through a calender roller pair of the draw frame to a sliver guiding channel of a rotary plate. The sliver is deposited through the rotary plate into a storage can. A mechanical severing device is operably disposed to sever the fiber sliver in an area between the calender roller pair and the outlet of the sliver guiding channel.

26 Claims, 4 Drawing Sheets

PROCESS AND DEVICE FOR FIBER SLIVER SEVERING ON A DRAW FRAME

BACKGROUND OF THE INVENTION

The present invention relates to a sliver severing device installed at the output of a draw frame to sever a delivered fiber sliver. Fiber sliver severing becomes necessary when the can has reached a state of fullness and must be replaced by an empty can.

According to the state of the art, safe severing of the fiber sliver in preparation of can replacement comprises severing the fiber sliver below the rotary plate, i.e. severing of the fiber sliver between the outlet of the rotary plate and the depositing in the can. This severing has, however, the disadvantage that following the severing operation, the remaining sliver end hangs from the outlet of the rotary plate. This involves the risk that the hanging sliver end may not completely enter an empty can which is subsequently provided. This may lead to interference with sliver deposit.

The solution according to DE-OS 38 07 239 places the severing device in the area between sliver funnel and calender rollers. This solution is based on the fact that, in the past, the severing of the fiber sliver was effected merely by briefly increasing the distance between sliver funnel and the pair of calender rollers. The sliver funnel was used as the moving element. It was disadvantageous that no second clamping of the fiber sliver was provided. This disadvantage is eliminated by DE-OS 38 07 239 in that the fiber sliver is clampingly held on the side of the sliver funnel and in that the severing operation occurs only then as a result of the change in distance due to the movement of the sliver funnel changing its location. Once the fiber sliver has been torn off, the distance between the sliver funnel and the pair of calender rollers is again reduced to the original distance.

The described solution has the disadvantage that this clamping device must also be included in the location-changing movement of the sliver funnel.

The prior solution has, however, also the disadvantage that the tearing point in the sliver above the pair of calender rollers is variable, and that the sliver end is released after the stopping of the calender rollers through the subsequent rotation of opening (additional effort) of the fiber guiding channel.

OBJECTS AND SUMMARY OF THE INVENTION

It is a principal object of the present invention to provide a process and device wherein when a can is replaced on a draw frame, the invention avoids the disadvantages of the state of the art at low cost, and achieves a defined sliver length in relation to the can by means of severing. Additional objects and advantages of the invention will be set forth in part in the following description, or will be obvious from the description, or may be learned by practice of the invention.

In preparation of can replacement, the can to be filled is standing under the rotary plate and the rotary plate is stopped. The fiber sliver feed to the draw frame is stopped.

It is a characteristic of the process according to the invention that the fiber sliver is severed in the area between the pair of calender rollers and the sliver guiding channel in preparation of can replacement.

A severing of the fiber sliver in this area has the advantage that the fiber sliver has always the same length after severing, whatever the position of the stopped rotary plate outlet may be. Once it has been pushed out of the outlet of the sliver guiding channel it hangs in a defined length at the can rim.

A second characteristic of the invention is the fact that when a clamping device is used, the severing of the fiber sliver takes place between the calender roller pair and the clamping device, whereby the fiber sliver is clamped and is then severed.

Another characteristic provides for the fiber sliver to be severed between the pair of calender rollers and a clamping location of the sliver guiding channel. Here it is advantageous if it is possible for the severed sliver beginning to be positioned in the sliver guiding channel. A later introduction of the sliver beginning can then be avoided.

Another characteristic of the invention provides for the fiber sliver to be severed without a clamping device and without forming a clamping point.

The fiber sliver is severed at little expense, as compared to former operating steps according to the state of the art (location-changing movement of the sliver funnel, subsequent rotation of the calender rollers) are avoided.

It is a characteristic according to the invention that a mechanical severing device is located between the calender roller pair and the sliver guiding channel. When severed by means of a mechanical severing device, the fiber sliver can in addition be clamped in order to achieve tension in relation to the severing device. It is a characteristic that a clamping device is provided between the severing device and the sliver guiding channel. The clamping device is provided with a grasper which can be moved when needed toward the fiber sliver by means of a control device and can grasp and clamp the fiber sliver. The severing device is provided with a severing mechanism and can be installed together with the clamping device on a common presentation device.

It is another characteristic of the device that a mechanical severing device is provided with a movable severing device which is moved at a right angle to the sense of transportation of the fiber sliver. As in this case, the fiber sliver is turned over at the opening rim of the sliver guiding channel and forms a clamping point, it being thus possible to dispense with the clamping device.

The fact that a clamping point is formed at the sliver guiding channel for the severing of the fiber sliver can also be realized by means of the characteristic of an arrangement of a swivelling wall segment or a swivel door near the opening of the sliver guiding channel. As a result of the rotation of the rotary plate, the swivel door must be positioned in the sense of the perpendicular movement of the fiber sliver. The perpendicular movement of the fiber sliver is carried out by a movable severing device. The movable severing device, e.g. a swivel arm or pulling arm with hook, places the fiber sliver on the swivel door. When the fiber sliver reaches the swivel door, the lower section of the swivel door swivels on the inner wall of the sliver guiding channel and forms a clamping point. Following the severing of the fiber sliver, the swivel door swivels back into its starting position and at the same time conveys the hanging sliver beginning into the sliver guiding channel. An external device for re-introduction of the sliver beginning into the sliver guiding channel is thus advantageously omitted.

It is another characteristic of the invention that the severing device, a sliver severing device, is located above the input opening of the sliver guiding channel. It is provided with a stretchable severing device which is guided obliquely into the sliver channel and meets up with the fiber sliver. The fiber sliver is frayed out at the severing point. The fraying out is possible because the stretchable severing device, together with the channel section of the air channel, covers a severing path which is equal to the staple length of the fiber sliver.

The device consists of a movable base body which slides axially in a guide and is pressed by an annular spring into a starting position. The movable base body is provided with an air channel. The air channel's diameter becomes wider beneath the outlet and is provided with a severing device capable of being stretched in the axial direction. The severing device is a bag-shaped formation the rim of which is fastened in the air channel. As with an air bag, the severing device can be inflated with compressed air and reaches greater volume so that it leaves the channel section. When this severing device is used, no clamping device or formation of a clamping point is necessary. The severed sliver beginning is preferably positioned in the sliver guiding channel.

Additional characteristics of the invention are explained below through the enclosed drawings.

DETAILED DESCRIPTION OF THE PREFERRED EMBODIMENTS

Figure 1:
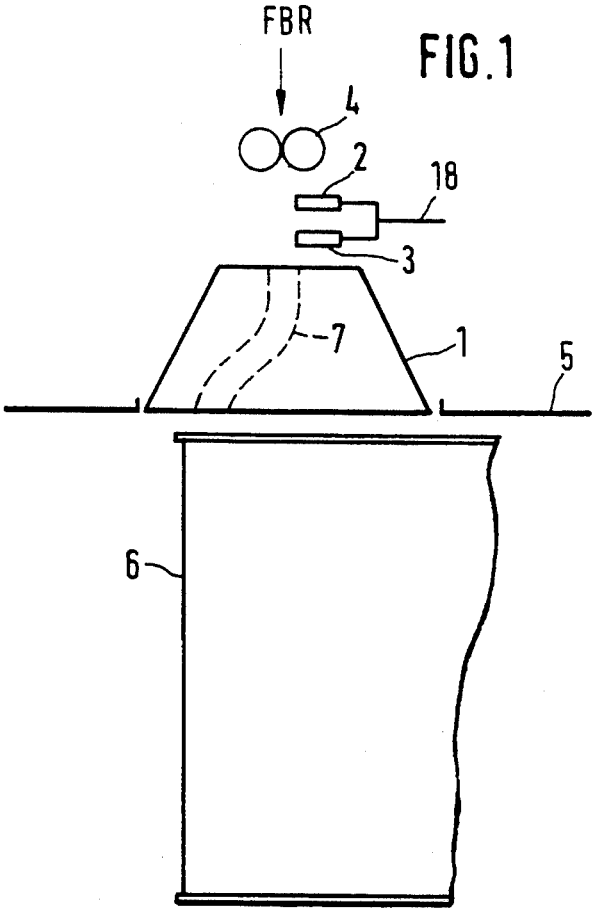
FIG. 1 shows an arrangement of the sliver clamping device and of the sliver severing device.

Reference will now be made in detail to the presently preferred embodiments of the invention, one or more examples of which are illustrated in the accompanying drawings. Each example is provided by way of explanation of the invention, and not as a limitation of the invention. The numbering of components in the drawings is consistent throughout the application, with the same components having the same number in each of the drawings.

As arrow FBR in FIG. 1 shows, the fiber sliver is conveyed through the calender roller pair 4 and into the sliver guiding channel 7. The sliver guiding channel 7 is part of the rotary plate 1 which rotates while the can is being filled. The rotary plate 1 is located within the machine table 5. The fiber sliver is finally deposited in the can 6 which is located below the rotary plate 1. FIG. 1 furthermore shows the clamping device 3 and the appertaining severing device 2. Both are installed in combination on a holding device 18. The holding device 18 is at the same time provided with all necessary supply lines so as to be able to set the severing device 2 and the clamping device 3 in operation. The clamping device 3 and the severing device 2 are located in the area between the calender roller pair 4 and the input opening of the sliver guiding channel 7.

Figure 2:
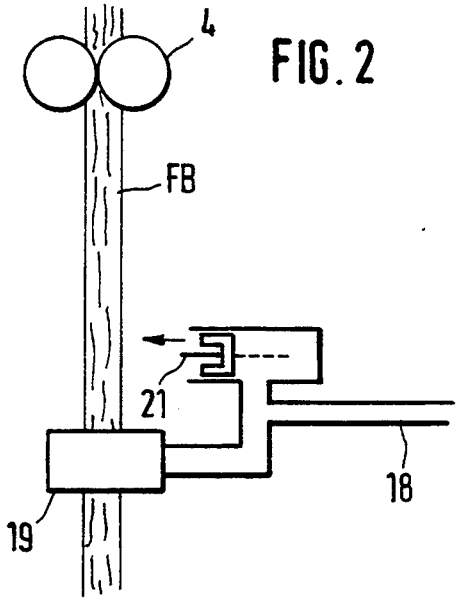
FIG. 2 shows a combined clamping device and severing device.

FIG. 2 shows a possible design of the clamping and severing device. A grasper 19 with two clamping jaws and a rotary knife 21 which is the severing device are respectively installed on a holding device 18 which is provided with a fork-shaped end piece at the ends of the fork. The drive, the control device, and the power transmission from the drive are not shown. FIG. 2 illustrates the situation in which the grasper 19 has already clamped the sliver with its two clamping jaws. The rotating rotary knife 21 is displaced at a right angle to the fiber sliver FB. When the rotary knife 21 comes in contact with the fiber sliver FB, the severing process begins. When the fiber sliver has been severed, the rotating rotary knife is stopped and is brought back into its starting position. The two clamping jaws of the grasper 19 open and they are also returned to a starting position. Severing is also possible by means of different mechanical severing devices such as, e.g., a swivel arm, a pulling arm with a hook, or with scissors.

Figure 4:
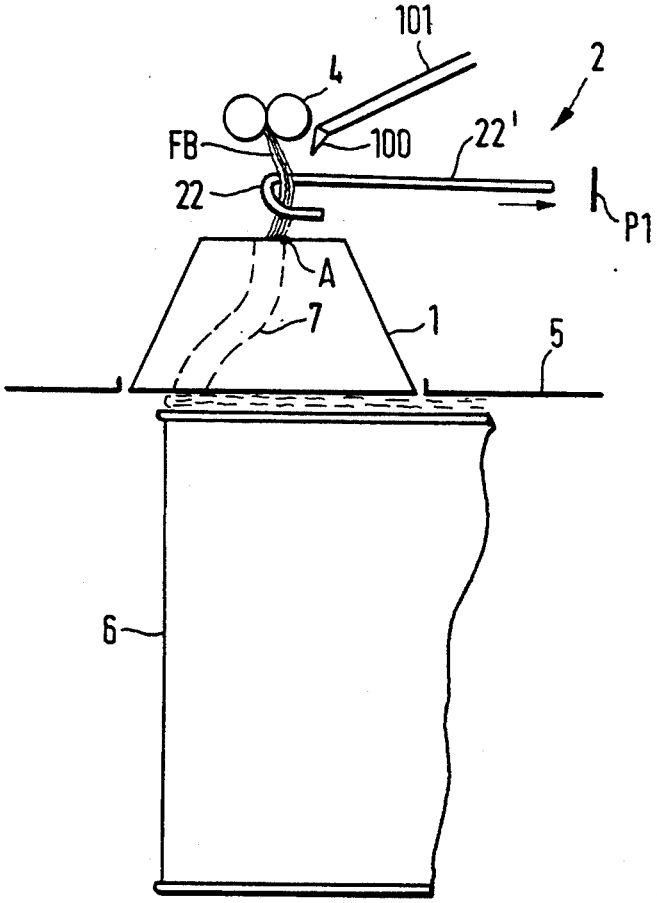
FIG. 4 shows a severing device with the formation of a clamping point on the sliver guiding channel.

It is another characteristic that the fiber sliver is severed mechanically in the area between the calender roller pair 4 and the sliver guiding channel 7 without clamping device 3. The severing device 2 severs between calender roller pair 4 and sliver guiding channel 7, with a clamping point A (FIG. 4) being formed at the opening rim of the sliver guiding channel 7 for the severing process. This clamping point A my be formed in any desired position of the stopped rotary plate 1. The severing device 2 may be provided with severing means consisting of a pulling arm 22' with a hook 22. However, a swivel arm can also be used, swivelling at a right angle to the fiber sliver. The hook 22 is horizontally movable. When it is moved out of its starting position, the hook 22 seizes the fiber sliver FB. In this movement, the fiber sliver FB is taken out of its path. It is folded over at the opening rim of the sliver guiding channel 7 and constitutes there a clamping point A. As the hook 22 continues to move into position P1, the fiber sliver is severed between the calender roller pair 4 and the sliver guiding channel 7.

Figure 5:
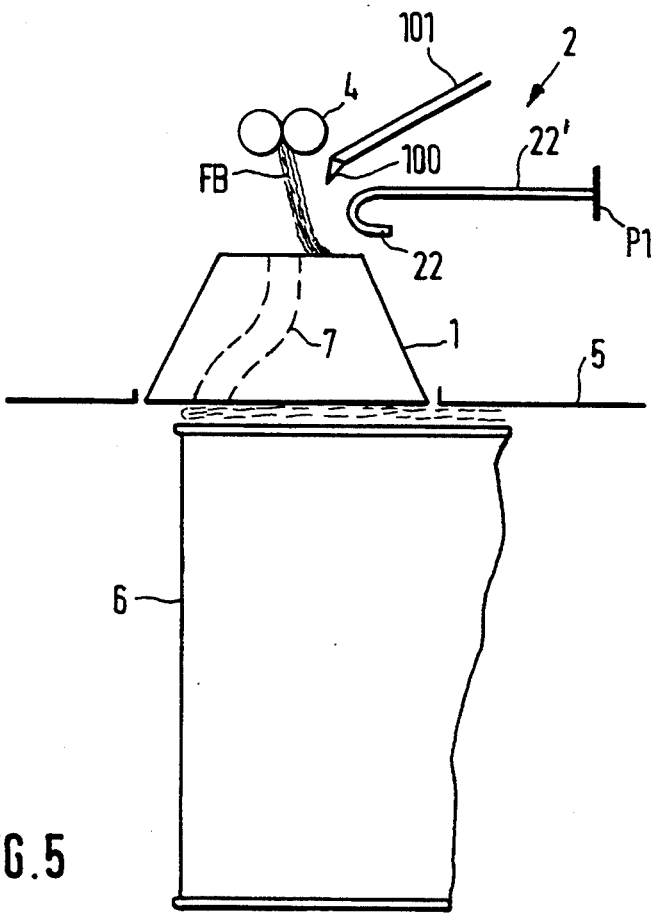
FIG. 5 shows a severing device according to FIG. 4 after severing.

FIG. 5 shows the sliver beginning taken out of its path next to the opening rim of the sliver guiding channel 7 after severing.

Figure 6:
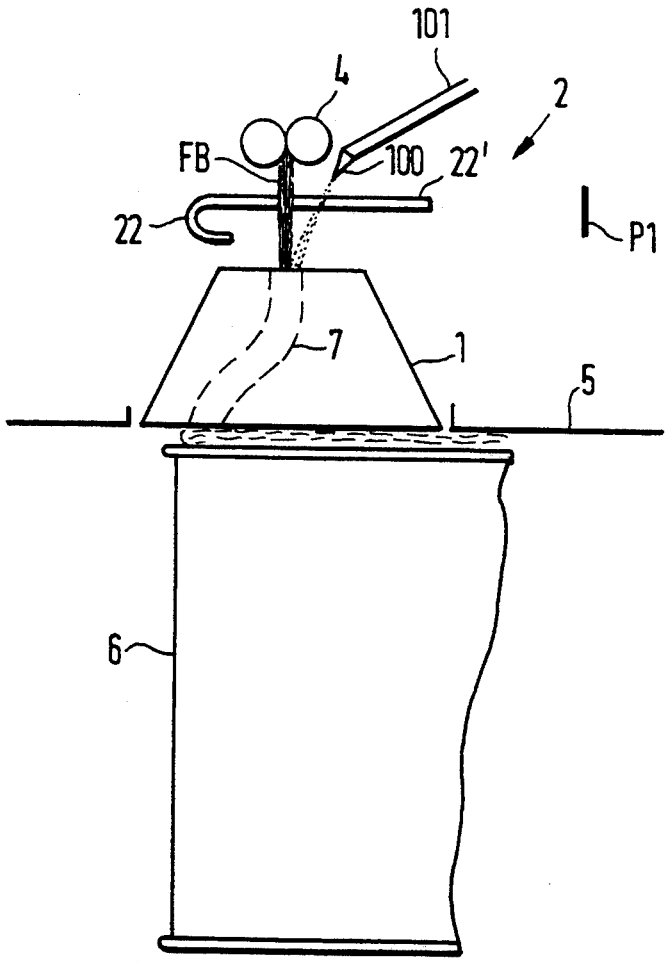
FIG. 6 shows the severing device according to FIG. 4 after severing with blowing nozzle.

FIG. 6 shows that the hook 22 was taken back into its starting position and the nozzle 100 is blowing air at that point in time so that the fiber sliver beginning is positioned in the sliver guiding channel 7. Once this has been achieved, the nozzle 100 stops blowing. The nozzle 100 is supplied with air via line 101, and the pneumatics and their controls are not shown here.

Figure 7:
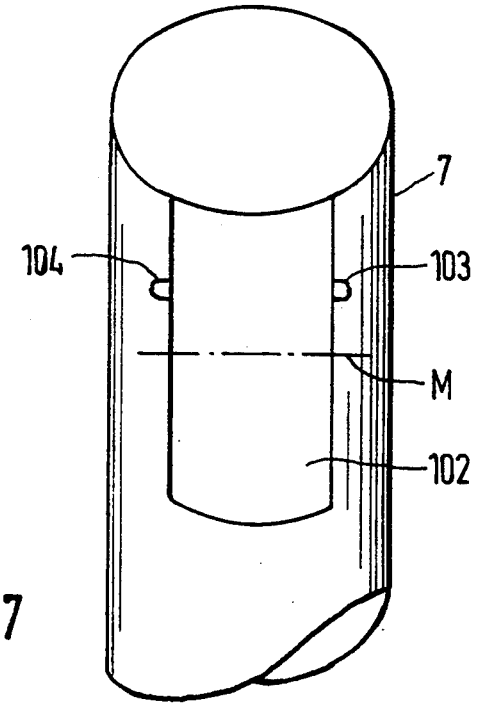
FIG. 7 shows the severing device and the sliver guiding channel with swivelling wall segment.
Figure 8:
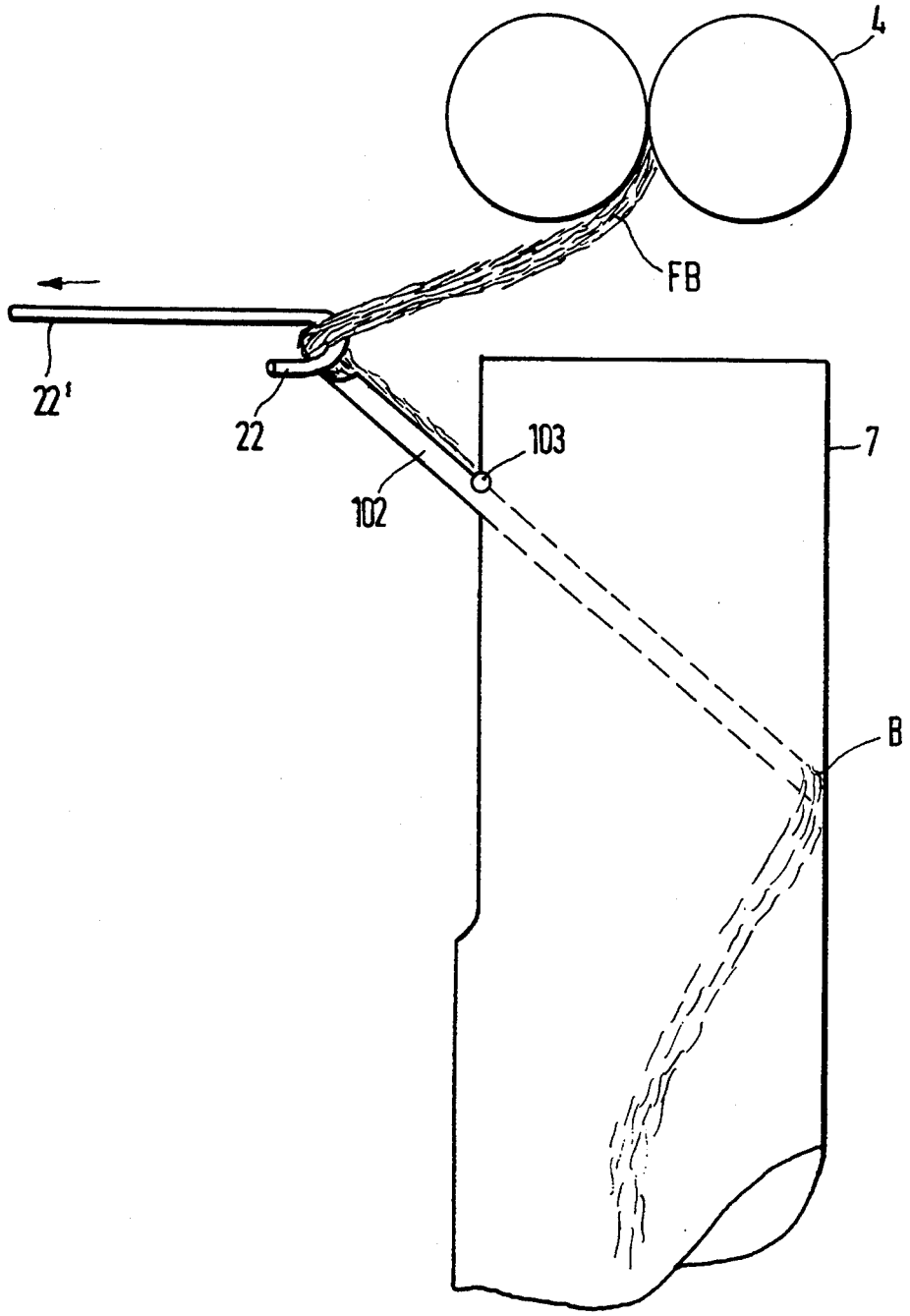
FIG. 8 shows a swivelling wall segment with clamping point.

FIG. 8, in combination with FIG. 7, shows another characteristic of the severing of the fiber sliver FB in the area between the calender roller pair 4 and the sliver guiding channel 7. A clamping point for the process of fiber sliver severing is also created with a sliver guiding channel 7 according to FIG. 7. FIG. 7 shows the opening area of the sliver guiding channel 7 into which the fiber sliver will be conveyed without rotary plate 1. This area of the opening of the sliver guiding channel 7 has a swivelling wall segment, a swivel door 102. The swivel door 102 is mounted in bearings 103 and 104.

The swivel door 102 can be swivelled around the bearings 03 and 104. The swivel door 102 forms an oblong, e.g. rectangular wall segment with one narrow side being flush with the opening rim. The bearings 103, 104 are slightly offset from the central axis M of the swivel door 102, in the direction of the opening.

According to FIG. 8, the severing device 2 has a pulling arm 22' with a hook 22 as the severing means. The hook 22 with the pulling arm 22' is located outside the conveying path of the fiber sliver FB. The fiber sliver FB is stopped. The hook is moved perpendicularly to the direction of movement of the fiber sliver FB. The hook 22 seizes the fiber sliver FB and takes it out of its conveying path. The rotary plate 1 with sliver guiding channel 7 and its swivel door 102 are positioned by controlling the drive which is not shown here, which always guides the fiber sliver FB to the swivel door in a defined movement of the hook 22. At the same time the contact of the fiber sliver FB causes the swivel door 102 to be swivelled as shown in FIG. 8 so that the lower portion of the swivel door 102 away from the opening of the sliver guiding channel holds the fiber sliver against the facing inner wall of the sliver guiding channel and constitutes a clamping point B. Further movement of the hook 22 severs the fiber sliver FB between the hook 22 and the clamping point B of the sliver guiding channel 7. Following the severing operation, the swivel door 102 swivels back into its original position shown in FIG. 7 as a result of the position of its center of gravity. This characteristic produces a very secure clamping point on the sliver guiding channel without requiring any external, presented clamping device. Here the sliver beginning hanging from the calender roller pair 4 and which was taken out of the path of movement of the fiber sliver is advantageously guided back into the sliver guiding channel. This return is effected by the swivel door 102. The sliver beginning need thus not be introduced later into the sliver guiding channel.

Figure 3:
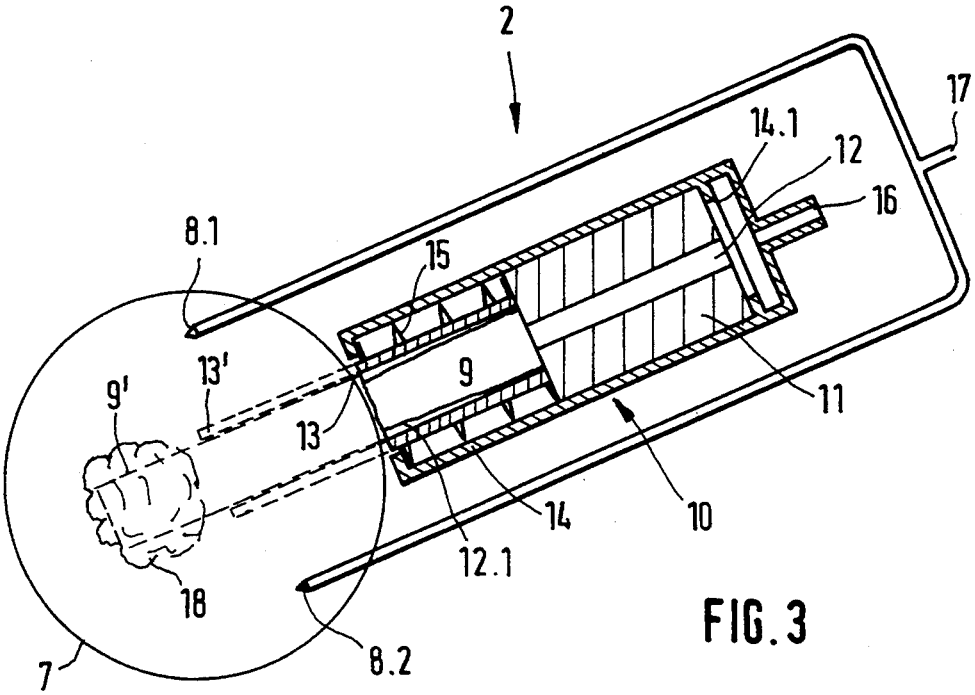
FIG. 3 shows a pneumatically adjustable severing device.

FIG. 3 shows an embodiment of a sliver severing device 2 where compressed air is used and where the compressed air flow, in addition to its centering effect on the fiber sliver, moves a mechanical sliver severing device 2 which severs the fiber sliver.

The figure shows an arrangement with two outer nozzles 8.1 and 8.2 which can be supplied with compressed air via supply line 17. Between these two nozzles, and centrally located, a moving sliver severing device 10 is provided which can also be supplied with compressed air via a supply line 16. The two outer nozzles are first supplied with compressed air and blow into the sliver guiding channel 7. The blowing of the nozzles centers the fiber sliver 18 between the blowing nozzles 8.1 and 8.2.

In brief time intervals following the start of the blowing action of the two nozzles, the supply of compressed air via supply line 16 sets a movable base body 11 of the sliver severing device 10 in motion. The sliver severing deice 10 takes a moving base body 11 in axial direction towards the fiber sliver 18 which is held by the calender rollers (not shown in the figure). During the moving phase of the moving base body 11, a stretchable separator 9 is in turn extended of the latter.

The sliver severing device 10 consists in particular of a moving base body 11 which is provided with an interior air channel 12. This air channel has a second section 12.1 of the overall length, with a larger diameter. The stretchable separator 9 is located in the segment with the larger diameter. The stretchable separator 9 is an oblong, rotatable and bag-shaped insert. This insert is inserted so that the closed side is flush with the outlet of the air channel 12. This separator 9 is made of a light stretchable and air-permeable rubber insert. The bag-shaped rubber insert is attached in its upper third in the air channel. The lower two thirds of the bag-shaped rubber insert are freely moving. The lower two thirds of the bag-shaped rubber insert are tapered in relation to the upper third when in starting position. As compressed air is supplied, the moving base body 11 is pushed against the annular spring 15. The moving base body slides then along guide 14 into position 13. Part of the moving base body 11 leaves the sliver severing device 10 in this process and is introduced into the sliver channel 7. During this process the stretchable separator 9 is inflated with compressed air (as an air bag), so that a longitudinal stretching occurs and the stretchable separator 9 is furthermore extended out of the movable base body 11 into position 9'. The stretchable separator meets the fiber sliver and presses it down, past its staple length, so that it is severed without much fraying. The separator 9 is the severing device. After a brief time the compressed air escapes from the separator 9 as the latter is air-permeable. The supply of compressed air via supply lines 16 and 17 is ended. The annular spring 15 brings the moving base body 11 back into its starting position. The movable separator 9 which is made in form of a stretchable rubber insert slides back into its starting position in the movable sliver severing device 11.

This embodiment also has the advantage that the sliver beginning coming from the calender roller pair 4 after sliver separation is already positioned in the sliver guiding channel 7.

It will be apparent to those skilled in the art that various modifications and variations can be made in the present invention without departing from the scope or spirit of the invention. For example, features illustrated or described as part of one embodiment can be used on another embodiment to yield a still further embodiment. It is intended that the present invention cover such modifications and variations as come within the scope of the appended claims and their equivalents.

We claim:

1. A process for severing a fiber sliver on a draw frame, the fiber being conveyed through a calendar roller pair and through a sliver guiding channel of a rotary plate and deposited into a storage can, said process comprising engaging the fiber sliver with a mechanical severing device between the calendar roller pair and the rotary plate at the inlet of the sliver guiding channel and severing the sliver in an area between the calendar roller pair and an outlet of the sliver guiding channel.

2. The process as in claim 1, further comprising clamping the fiber sliver at a point between the calendar roller pair and the sliver guiding channel and severing the fiber sliver between the clamping point and the calendar roller pair.

3. The process as in claim 2, including clamping the fiber sliver before said severing.

4. The process as in claim 1, further comprising defining a clamping point for the fiber sliver at the sliver guiding channel and severing the fiber sliver between the sliver guiding channel clamping point and the calendar roller pair.

5. The process as in claim 4, including clamping the fiber sliver by folding the fiber sliver on an opening rim of the sliver guiding channel.

6. The process as in claim 5, further comprising blowing the severed end of the fiber sliver into the sliver guiding channel with a nozzle device.

7. The process as in claim 4, further comprising clamping the fiber sliver at a point within the sliver guiding channel by means of a swivel door forming part of the sliver guiding channel.

8. The process as in claim 7, further comprising moving the fiber sliver in its path between the calendar roller pair and the sliver guiding channel by means of a movable severing device, the moved sliver causing the swivel door to swivel and to clamp the fiber sliver within the sliver guiding channel.

9. The process as in claim 8, including contacting the swivel door with the moved sliver at a point above a swivel bearing of the swivel door thereby causing a lower half of the swivel door to swivel towards an opposite portion of the sliver guiding channel, the fiber sliver being clamped between the lower half of the swivel door and the opposite portion of the sliver guiding channel.

10. The process as in claim 1, comprising severing the fiber sliver generally adjacent an opening of the sliver guiding channel.

11. The process as in claim 10, comprising severing the fiber sliver with a stretchable separator generally within the sliver guiding channel.

12. The process as in claim 11, further comprising centering the fiber sliver with blowing nozzles generally immediately before said severing.

13. A draw frame comprising a calendar roller pair for conveying a fiber sliver through a sliver guiding channel of a rotary plate for being deposited into a storage can, said draw frame further comprising a mechanical severing device operably disposed between said calendar roller pair and the rotary plate at an inlet of said sliver guiding channel for engaging said fiber sliver before said sliver enters said sliver guiding channel, said mechanical severing device configured for severing the fiber sliver between said calendar roller pair and an outlet of said sliver guiding channel.

14. The draw frame as in claim 13, wherein said mechanical severing device comprises a movable separating device configured to move generally perpendicularly to a path of the fiber sliver between said calendar roller pair and said sliver guiding channel inlet.

15. The draw frame as in claim 14, wherein said mechanical severing device further comprises a clamping device operably configured for clamping the fiber sliver between said sliver guiding channel inlet and said calendar roller pair.

16. The draw frame as in claim 15, wherein said clamping device comprises two graspers which are configured to seize and clamp the fiber sliver upon receipt of a signal from a control device.

17. The draw frame as in claim 15, wherein said movable separating device comprises a rotating rotary knife device.

18. The draw frame as in claim 13, wherein said sliver guiding channel comprises a swivelling wall segment, said wall segment configured for clamping the fiber sliver within said sliver guiding channel.

19. The draw frame as in claim 18, wherein said swivelling wall segment comprises a swivel door.

20. The draw frame as in claim 19, wherein said swivel door comprises bearings disposed above a centerline of said door so that a greater portion of said door is disposed below said bearings.

21. The draw frame as in claim 20, wherein said door portion below said bearings is configured for clamping the fiber sliver against a portion of said sliver guiding channel generally opposite said door.

22. The draw frame as in claim 21, further comprising a pulling arm device configured with a hook device at one end thereof, said pulling arm device movable in a direction generally perpendicular to a running path of the fiber sliver between said calendar roller pair and said sliver guiding channel, said pulling arm device deflecting the path of the fiber sliver causing the fiber sliver to contact and swivel said door which clamps the fiber sliver within said sliver guiding channel, said pulling arm device also severing the fiber sliver.

23. The draw frame as in claim 13, wherein said mechanical severing device comprises a pulling arm configured with a hook device at one end thereof for seizing the fiber sliver, said pulling arm movable in a direction generally perpendicular to a running path of the fiber sliver between said calendar roller pair and said sliver guiding channel inlet.

24. The draw frame as in claim 13, wherein said mechanical severing device is operably disposed generally at said inlet of said sliver guiding channel.

25. The draw frame as in claim 24, wherein said mechanical severing device comprises a movable base body surrounded by a guide, said movable base body held by an annular spring against a stop defined in said guide, said severing device further comprising a stretchable separator disposed within an air channel segment configured with said movable base body, wherein upon supplying compressed air to said severing device said base body moves against said annular spring with said air channel segment being moved out of said guide generally towards said sliver guiding channel opening, said stretchable separator being inflated so as to sever the fiber sliver generally at said sliver guiding channel opening.

26. The draw frame as in claim 25, wherein said stretchable separator and said air channel segment generally cover a severing distance generally equal to the staple length of the fiber sliver from a point where the fiber sliver is contacted by said stretchable separator to a point where said stretchable separator reaches an end separating position.

* * * * *